US005901628A

United States Patent [19]

Sakamoto et al.

[11] Patent Number: 5,901,628

[45] **Date of Patent: *May 11, 1999**

[54] DIE LIFTING SYSTEM FOR A TURRET PUNCH PRESS

[75] Inventors: Hiroichi Sakamoto; Kenichi Marui, both of Kagamigahara, Japan

[73] Assignee: Murata Kikai Kabushiki Kaisha, Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/722,927

[22] Filed: Sep. 30, 1996

[30] Foreign Application Priority Data

Oct. 2, 1995 [JP] Japan ..... 7-279802

[51] Int. Cl.[6] ..... B21D 37/14; B26D 5/02

[52] U.S. Cl. ..... 83/552; 83/563; 83/658; 83/685

[58] Field of Search ..... 83/549, 552, 557, 83/558, 563, 658, 559, 621, 685

[56] References Cited

U.S. PATENT DOCUMENTS 3,777,601 12/1973 Strandell ..... 83/563 X
5,195,413 3/1993 Johnson ..... 83/552 X
5,342,276 8/1994 Fujiwara et al. ..... 83/563 X
5,346,454 9/1994 Hayashi ..... 83/552 X

FOREIGN PATENT DOCUMENTS 3-133527 6/1991 Japan ..... 83/552
5-169155 7/1993 Japan ..... 83/552

*Primary Examiner*—Clark F. Dexter
*Attorney, Agent, or Firm*—Armstrong, Westerman, Hattori, McLeland & Naughton

[57] ABSTRACT

A single die raising device is arranged on a turret for raising a die used for forming so that such die-raising device does not become an obstruction when the work is delivered. Apparatus is described in which each of a plurality of form dies (5) arranged on a lower turret (2) can be raised. A die-raising device (16) that raises the die (5) from below the lower turret (2) is arranged so as to be utilized in one place, for example, in the punch position (P), of the rotation path (L) of the die (5) by rotation of the lower turret (2). A projecting part (29*a*) that projects lower than the lower surface of the lower turret (2) is arranged on each die (5). The die raising device (16) comprises a retracting member (17) which is able to retract horizontally and has a horizontal surface (17*b*) and a slanting surface (17*a*) which can lift up the projecting part (29*a*) of the die (5), and an actuator (18).

3 Claims, 5 Drawing Sheets

DIE LIFTING SYSTEM FOR A TURRET PUNCH PRESS

BACKGROUND OF THE INVENTION

1. TECHNICAL FIELD

The present invention relates to a die raising system of a turret punch press which raises a form die only when used.

2. BACKGROUND ART

As shown in FIG. 5, a turret punch press includes an upper turret 1 and lower turret 2 disposed on a frame 3 about the same center and arranges each type of punch 4 and die 5 at respective stations of the upper turret 1 and the lower turret 2. Punch 4 is vertically driven at a predetermined punch position P by being connected to a ram 6. A flat work W is moved forwards, backwards, left and right on the work table 8 by a work holder 7 so that a predetermined portion is positioned in the punch position P. The work holder 7 is attached to a cross slide 10 and the cross slide 10 is positioned so as to be freely movable to the left and right (in the direction of the X axis) on a carriage 9 which is freely movable forwards and backwards (in the direction of the Y axis) on the frame 3.

Work table 8 comprises a flat table provided with a free bearing, or the like, in order to move the flat board-shaped work W over the top surface of the die 5. As a result, when press processing of a burring form part 11, nib emboss form 12, louver form part 13, or the like, as shown in FIGS. 6A through 6D is carried out, the die 5, being inverted, is formed as a convex shape opposite in shape to the hole being processed and each formated part 11-13 is produced with the work W facing upwards.

In this case, as the stroke of the ram 6 is fixed, the punch 4 is shortened and the upper surface position of the die 5 (die heighth) is set higher than a die used for hole forming by the forming height (FIG. 6D) of form parts 11-13 and, in short, is higher than the load surface 8*a* of the work W from the work table 8 by the forming height H'.

In this way, as the die height of the form die 5 is raised, if the form dies 5 are contained in the lower turret 2, the work W is also lifted up by that die 5 when hole processing is carried out. Due to this, besides the detrimental influence on the accuracy of the processing, the lower surface of the work W may be damaged or deformed. Furthermore, as a result of the damage to the work W the next station may be inoperable.

In order to solve these problems, a device is provided in which the height of the form die may be adjusted by a fluid pressure apparatus and the form die is projected only when used (Utility Model Laid Open: Hei 1-10111), or a device that lifts the die by a cam or fork-shaped member (Patent Laid Open: Hei 7-34939, Utility Model Laid Open: Hei 7-184416) have also been proposed.

However, as all of these devices are arranged with a die raising system on the turret for each die, when there are many form dies arranged about the turret, the number of die raising systems and drive sources increase by the number of dies that are provided and, as a result, the cost increases.

SUMMARY OF THE INVENTION

In order to solve the aforementioned problems, it is an object of the present invention to provide a die raising system for a turret punch press which is able to selectively raise each of a plurality of dies by the arrangement of a single die raising means on the turret.

On a turret punch press provided with raisable form dies in a plurality of places in the circumferential direction about the lower turret, the die raising system of the present invention is provided below the lower turret with a die raising means for raising a die so that the die raising means can be utilised in one place on the rotation path of the die by rotation of the lower turret.

Accordingly, the die can be raised by the die raising means by the rotation of the turret and the movement of the form die to a position corresponding to that of the die raising means. As a result, there is no need to provide a the die raising means for each die and a plurality of dies may be selectively raised by the provision of a single die raising means per turret.

In the aforementioned structure, a projection part that projects further down than the lower surface of the lower turret may be disposed on the lower part of the die and the aforementioned die raising means acts on that projection part. Due to this, the die raising means may be positioned without taking the hole or the turret, which positions the die, into account. In short, the restrictions on positioning of the die raising means are removed.

Further, the aforementioned die raising means may comprise a retracting member which can retract in the horizontal direction having a camming surface that includes a slanting surface part on which the projecting part can be loaded and a horizontal part in continuance with the top edge of this slanting surface part, and an actuator that retracts this retracting member.

In this situation, the die is not directly raised but indirectly raised by the slanting surface of the retracting member. As the load is imposed on the horizontal surface in this raised state, there is no exertion of a punch load on the actuator and the die can be reliably maintained in the raised position by an actuator of low output.

Yet further, the aforementioned actuator may be positioned towards the center of the lower turret and may be able to retract the aforementioned retracting member from the inside of the lower turret. As a result, the actuator does not project out of the turret and the entire machine may be made more compact.

DETAILED DESCRIPTION OF THE PREFERRED EMBODIMENT

Figure 4A:
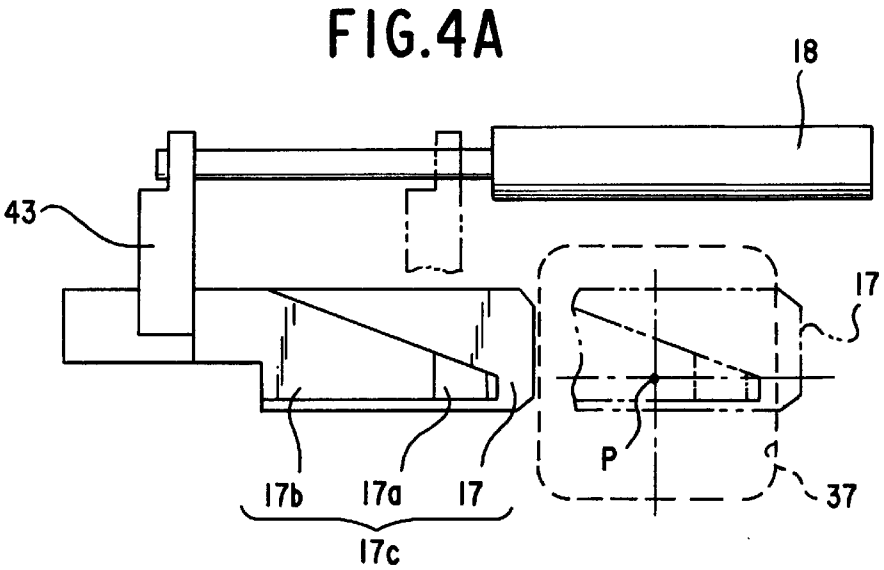
FIG. 4A is a drawing showing the movements of the retracting member and FIG. 4B is a drawing showing the retracting member and the surrounding parts as seen from the front surface of the retracting direction.

One embodiment of the present invention will be described using FIGS. 1 through 4. The description of this embodiment is applied to the schematic structure of the turret punch press shown in FIG. 5. An explanation of the parts having the same labels as those in FIG. 5 have been omitted.

Figure 2A:
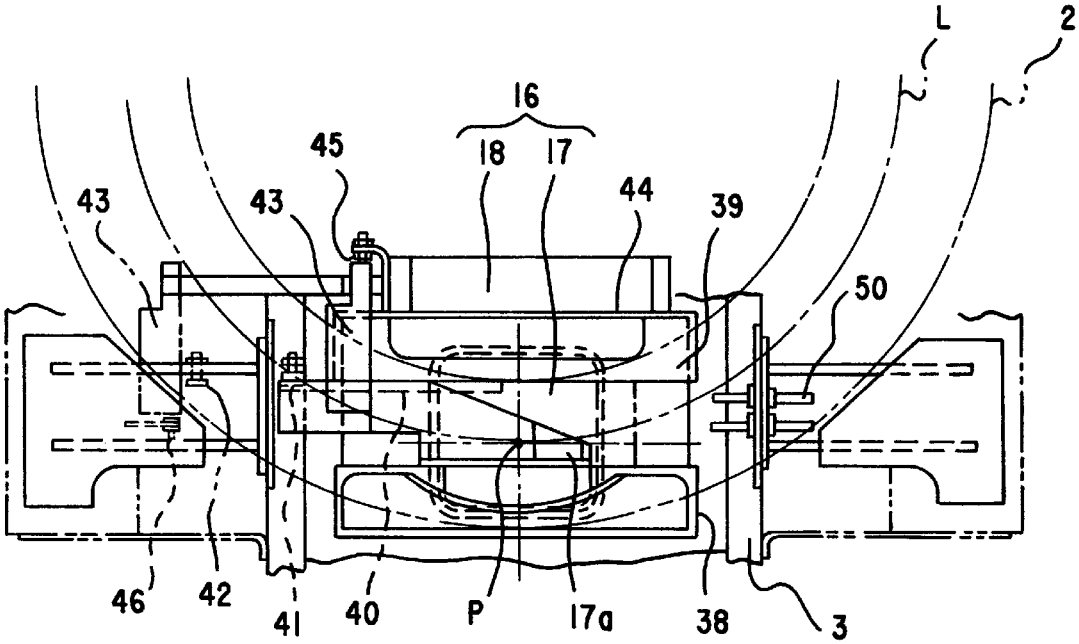
FIG. 2A is a top plan view of the die raising system of FIG. 1
Figure 2B:
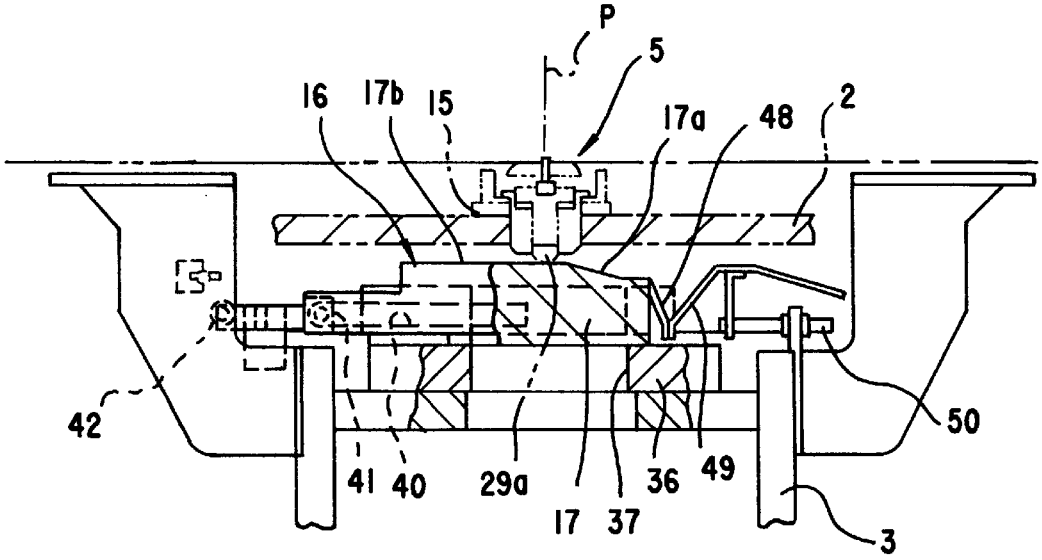
FIG. 2B is a broken front view of the same.
Figure 3:
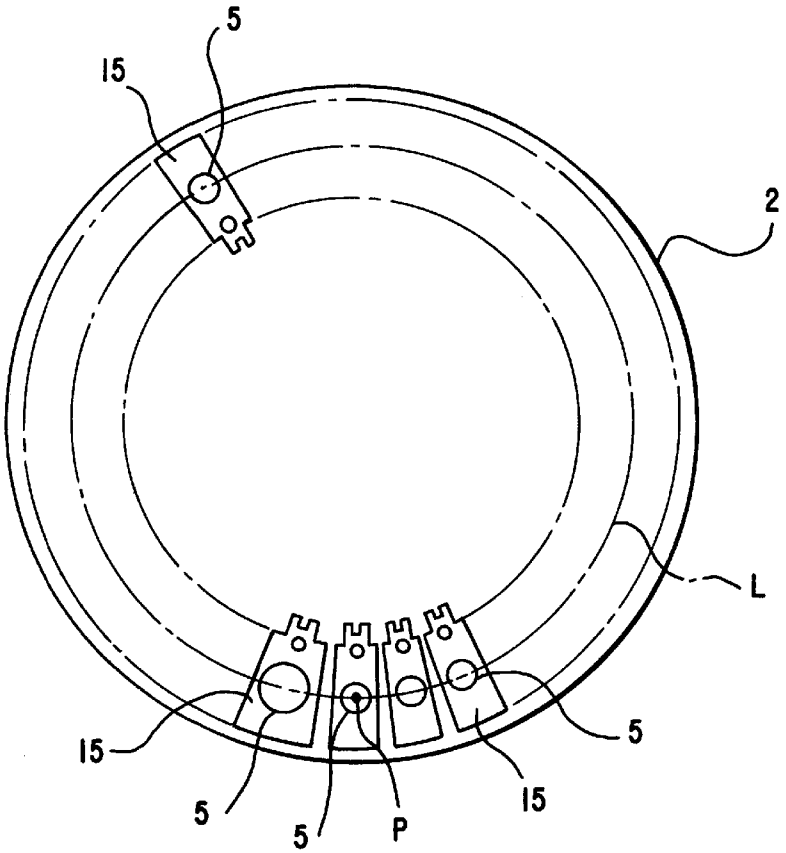
FIG. 3 is a top plan view of the lower turret in which parts thereof are omitted.

As shown in FIG. 3, a plurality of form dies 5 are positioned along the circumference of a lower turret 2 via each die support table 15. Of these, a plurality of the form dies 5 are for forming and are freely raisable. A die raising means 16 (FIG. 2) for raising the form die 5 from below the lower turret 2 is arranged in order to act upon the form die 5 in one place in the rotation path L of the form die 5 by rotation of the lower turret 2. In the present embodiment, the aforementioned one place is the punch position P. The die raising means 16 comprises a retracting member 17 having a slanting surface 17*a* which forms part of a camming surface (described later) and an actuator 18 for carrying out that retraction and advancement.

Figure 1:
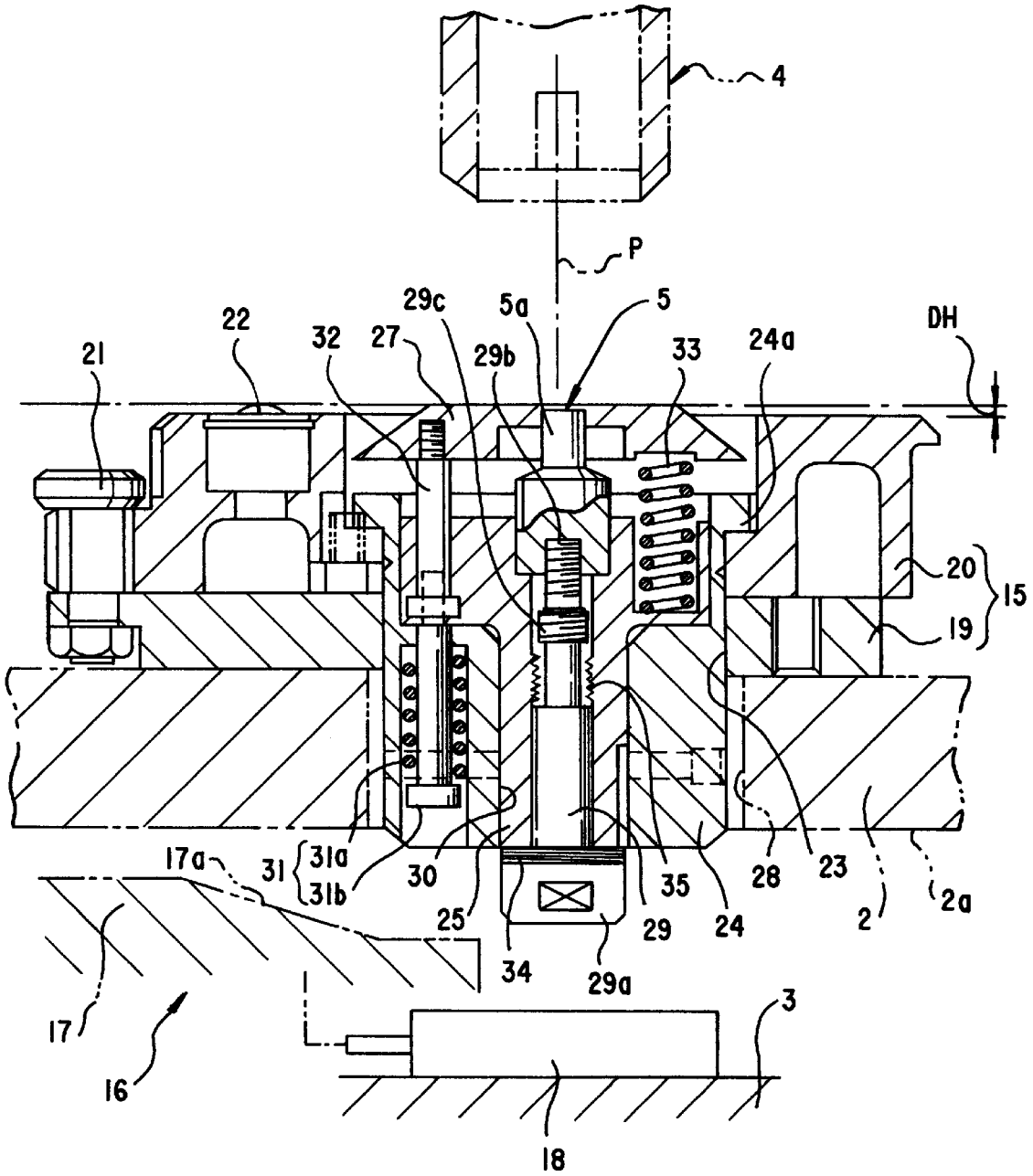
FIG. 1 is an explanatory drawing combining a cross section of the die raising system constituting one embodiment of the present invention and a drawing partially showing the typical parts thereof.

As shown in FIG. 1, the die support table 15 comprises a support table base board 19 and a support table main body 20 loaded on this. The support table base board 19 is bolted to the upper surface of the lower turret 2. The support table main body 20 can be freely pulled and positioned in the turret radial direction with respect to the support base board 19 and is fixed to the support table base board 19 by a positioning pin 21 and a lock pin (not shown in the drawings). A work guide means such as a free bearing 22 that guides the work at the die height DH is arranged on the upper surface of the support table main body 20.

A counter bored die attachment hole 23 passing through the support table main body 20 and the support table base board 19 is formed approximately at the center of the die support table 15 and attached to which is the cylindrical die outer case 24 being a component of the form die 5. The ring-shaped projection 24*a* which projects from the upper periphery of the die outer case 24 is connected to the counter bored surface of the die attachment hole 23. The lower part of the die outer case 24 projects below the support table base board 19 and is inserted in the die positioning hole 28 arranged in the lower turret 2.

The die 5 has a die tool 5*a* comprising a convex part for pressing, a die holder 25 of which the upper end is attached to of the die tool 5*a*, the aforementioned die outer case 24 and an ejector plate 27. The bolt head of the bolt 29 which attaches the die tool 5*a* to the die holder 25 projects below the lower surface 2*a* of the lower turret 2 as a projection part 29*a* that contacts the die raising means 16. The projection part 29*a* is a cylinder having a flat surface on the side. The bolt 29 is inserted in the central hole of the die holder 25, screws the male screw 29*b* at the upper end to the lower surface of the die tool 5*a* and attaches the projection part 29*a* being the bolt head, to the lower surface of the die holder 25. A punch shim 34 is inserted between the projection part 29*a* and the lower surface of the die holder 25. A middle screw 29*c* that screws together with a stopper female screw part 35 arranged on the inside surface of the central hole of the die holder 25 is formed on the bolt 29. The middle screw 29*c* is for preventing the bolt 29 from falling out when dismantling and is positioned higher than and outside the stopper female screw part 35 when the die tool 5*a* is in the attached state.

The die holder 25 is formed as a stepped shaft shape with the upper part having a larger diameter and is inserted so as to be freely raisable in the counter bored raising guide hole 30 arranged in the die outer case 24. The die outer case 24 incorporates a return means 31 that elastically returns the die holder 25. This return means 31 comprises a return spring 31*a* and a stripper bolt 31*b*. The stripper bolt 31*b* is inserted into the return means storage hole formed in the lower surface of the die outer case 24 and passes through that case. The upper end is screwed to the large diameter part of the die holder 25. The return spring 31*a* comprises a coil spring and is inserted between the bolt head and the base of the return means storage hole around the periphery of the stripper bolt 31*b*. The ejector plate 27 is supported by the die holder 25 so as to be freely raisable by a guide pin 32 and is pushed upwards by the force of the ejector spring 33. The guide pin 32 passes vertically along a hole arranged in the die holder 25 and by attachment of the lower end pin head with the counter bored surface of that hole, controls the upper end position of the ejector plate 27.

Figure 4B:
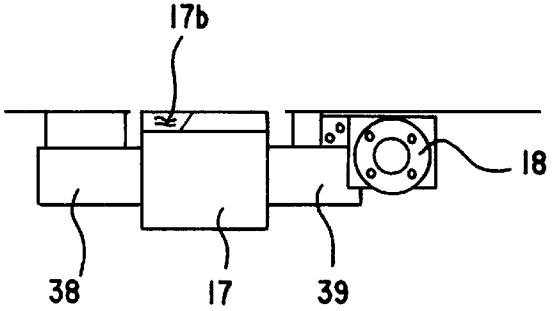
Figure 5:
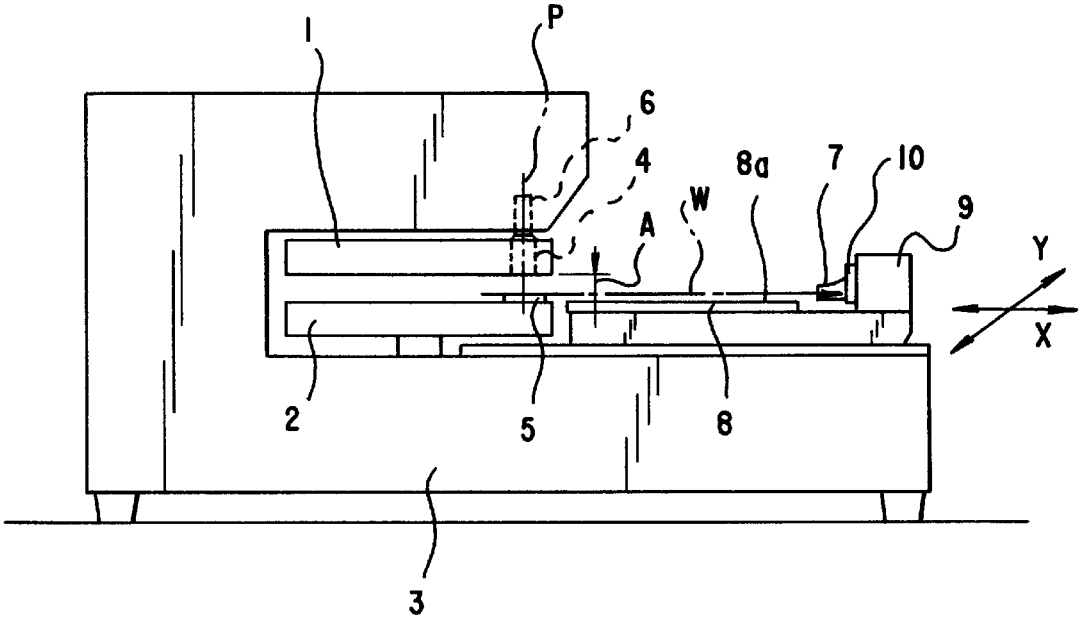
FIG.5 PRIOR ART
FIG. 5 is a side view of a conventional turret punch press.
Figure 6A:
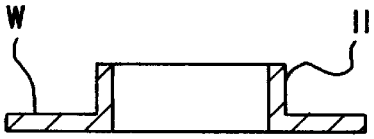
FIGS. 6A, 6B, 6D are cross section views of examples of workpieces containing shapes produced by various types of conventional form processing tools
Figure 6B:
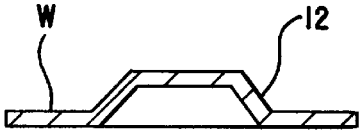
Figure 6C:
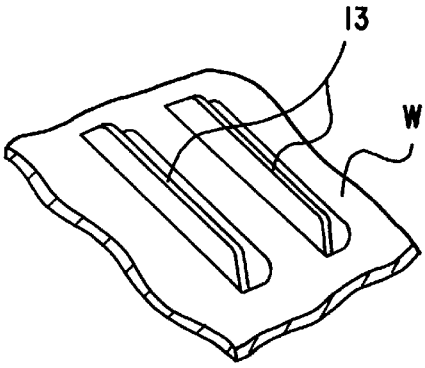
FIG. 6C is a perspective view of another press processing example.
Figure 6D:
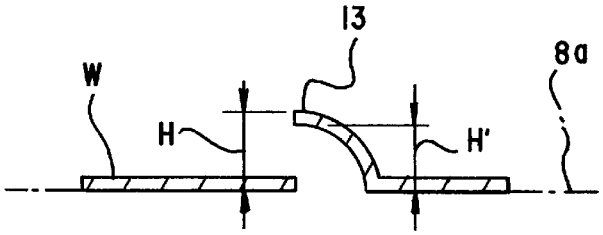

As shown in FIG. 2B and FIG. 4, the retracting member 17 of the die raising means 16 is positioned on a support surface designed by the upper surface of a punch force receptor 36 and is able to retract freely so that it cuts across the slug ejection hole 37 of the punch force receptor 36 arranged in the punch position P of the frame 3. The retraction direction of the retracting member 17 is at right angles to the radial direction of the lower turret 2 and that retraction direction is restricted by a pair of guide members 38,39 (FIG. 2A, FIG. 4B) positioned above the punch force receptor 36. Also in the retracting member 17, a guide groove 40 is formed in the side surface of the side of the turret center and retraction is guided by a plurality of guide rollers 41,42 present in this guide groove 40. These guide rollers 41,42 are positioned on the frame 3 and the guide roller 42 of one side separates from the guide groove 40 when the retracting member 17 is in the retracted position. It should be noted that in FIG. 1, for the ease of description, the retraction direction of the retracting member 17 is actually 90° different to that which is shown.

The retracting member 17 has a trapezoid enlarged part 17*c* (FIG. 4A) of which the upper surface slopes to form a point. That part on the tip side slopes downwards toward the tip forming a slanting surface forms a camming surface that 17*a* and the part of the camming surface on the base side forms a horizontal surface 17*b*. Due to the slanting surface 17*a* and horizontal surface 17*b*, the retracting member 17 has a trapezoid shape (FIG. 2B) when viewed from the side.

The actuator 18 comprises a fluid pressure cylinder and the tip of that piston rod is connected to the rear end of the retracting member 17 by a connection member 43. The actuator 18 is positioned toward the center of the lower turret 2 with respect to the punch position P and the whole structure is positioned on the frame 3 via the attachment table 44 so that it is contained below the lower turret 2. In this way, the actuator 18 does not protrude out of the turret by being contained below the lower turret 2 and the entire machine can be made more compact.

It should be noted that detection sensors 45,46 are arranged on forms a camming surface that of the camming surface of the retracting member 17 respectively. Proximity sensors, or the like, that detect the connecting member 43 are used on these sensors 45,46. Also, a scrap prevention guide 48 is attached to the end surface of the retracting member 17 and a scrap prevention guide 49 contacting the opposite surface of this is attached to the frame 3 by an adjustable screw 50. Further, all of the projecting parts 29*a* of each form die 5 arranged on the lower turret 2 are arranged in the center of the die holder 25 and are positioned to follow the same rotation path L.

Hereafter, the actions of the above described structure will be described. Apart from when form processing, in short, at normal hole processing and when the turret is rotated, the retracting member 17 is retracted to the retracted position as shown by the solid line in FIG. 4A separated from the slug exhaust hole 37.

When form processing is carried out after rotation of the turret, the retracting member 17 is advanced by the actuator 18 to the forwardmost position, as shown in FIG. 2 or the dotted line in FIG. 4A. In association with this advancement, the projection part 29*a* of the lower surface of the form die 5 is moved by the camming surface being loaded on the slanting surface 17*a* of the retracting member 17 and moves to the horizontal surface 17*b*. Due to this, the die tool 5*a* on the form die 5 rises with the die holder 25 repelling against the return spring 31*a* and the upper edge of the die tool 5*a* is maintained at a height slightly higher than the die height DH used for hole processing. When the retracting member 17 advances as far as the forwardmost edge, it cuts across the slug exhaust hole 37 and the front and rear parts ride onto the punch force receptor 36. As a result, the pushing force from when pressing is carried out using the punch 4 is taken up by the punch force receptor 36 via the retracting member 17 from the die holder 25 and the projection part 29*a*. It should be noted that as the retracting member 17 is arranged in the punch position P, raising of any of the form dies 5 on the lower turret 2 can be carried out.

When form processing has finished, the retracting member 17 once again retracts, the die holder 25 drops down by being forcibly returned by its weight and the return spring 31*a*, and the upper edge surface of the die tool 5*a* sinks lower than the die height DH. Due to this, damage to the reverse side of the work by the form die 5 when moving the work and instability of the work can be prevented and the work can be moved without any decrease in moving speed.

According to this die raising system, a plurality of form dies 5 can be selectively raised by the arrangement of a single die raising means 16. Due to this, there is no need to arrange a die raising means and an actuator for each individual form die 5, the structure can be simplified and the cost can be reduced.

Further, the form die 5 is not directly raised from below and as it is indirectly raised by the retracting member 17, there is no effect of the punch force of the form die 5 on the actuator 18 and the form die 5 can be reliably maintained in a raised position also at form processing times.

Yet further, all of the projection parts 29*a* of the respective form dies 5 arranged on the lower turret 2 are disposed substantially at the center of the die holder 25 and moreover are positioned so that they follow the same rotation path L. Thus a plurality of form dies 5 can be raised without any problems even if the size of the die holder 25 differs.

Yet further still, as the form die 5 is raised by pushing the center of the die holder 25, there is no bias of the die holder 25 and the form die 5 can be raised smoothly.

As the die raising system of the turret punch press of the present invention is provided with a die raising means for raising the die from below the lower turret so that it is utilised in only one place on the rotation path of the die defined by rotation of the lower turret, a plurality of dies may be raised by the arrangement of a single die raising means on the turret.

On this structure, a projection part is arranged on the lower part of the die and the aforementioned die raising means acts on that projection part. Due to this, the die raising means may be positioned without taking the hole or the turret which positions the die into account and the restrictions on positioning of the die raising means are removed thus increasing the range of possible positioning. The aforementioned die raising means may comprise a retracting member having a slanting surface on which the projecting part can be loaded and a horizontal surface, and an actuator for this retracting member. In this situation, the die can be reliably maintained in the raised position by an actuator of low output.

Yet further, the aforementioned actuator may be positioned towards the center of the lower turret and may be able to retract the aforementioned retracting member from the inside of the lower turret. In this situation, the actuator does not project out of the turret and the entire machine may be made more compact.

What is claimed is:

1. A turret punch press comprising;

a frame;

a punch reciprocable along a vertical axis and carried by said frame;

a lower turret mounted on said frame for rotation about an axis parallel to said axis of said punch;

a plurality of form dies disposed at spaced locations about the circumference of said lower turret;

means in said lower turret receiving each said form die for sliding movement along an axis parallel to said axis of said punch and of said axis of turret rotation, respectively;

a body defining a support surface and fixed to said frame, said support surface extending beneath said lower turret and intersecting said axis of said punch; and a die raising system operative to selectively raise one of said form dies into a position to cooperate with said punch when said lower turret is rotated to place said one form die into alignment with said punch, including:

a retracting member mounted for reciprocable sliding movement on said support surface intermediate said support surface and said lower turret, said retracting member being positioned with respect to said axis of said punch to reciprocate from a first position removed from said axis of said punch to a second position intersecting said axis of said punch, an actuator mounted on said frame in a position remote from said axis of said punch, said actuator being connected to said retracting member and being operative to move said retracting member between said first and second positions, a projection part formed on each of said form dies and projecting into a space between said lower turret and said support surface, said projection part defining a follower engageable with a flat surface of said retracting member disposed substantially perpendicular to said axis of said punch when said one form die is operatively positioned with respect to said punch, and a camming surface formed on said retracting member to engage said one form die when said retracting member is moved from said first position to said second position, said actuator being operative to move said retracting member so that said camming surface on said retracting member engages said projection part of said one form die operatively disposed with respect to said punch for raising said one form die into an elevated position and for holding said one form die on said flat surface in said elevated position, whereby impact forces produced by said punch on said form die are transferred to said support surface.

2. The turret punch press as recited in claim 6, wherein the camming surface on the retracting member is defined by a slanting surface engageable with the projecting part on said one form die for raising said one form die, and said flat surface is further substantially perpendicular to the sliding axis of said one form die, said flat surface extending from a top edge of the slanting surface for holding said form die in said elevated position.

3. The turret punch press as recited in claim 2, wherein the actuator is disposed in a space covered by the lower turret and positioned radially inwardly with respect to the retracting member.

* * * * *